United States Patent [19]

Hash

[11] 4,368,679

[45] Jan. 18, 1983

[54] APPARATUS AND METHOD FOR FORMING TUFTED PILE FABRIC

[75] Inventor: Juel T. Hash, Tunnel Hill, Ga.

[73] Assignee: Shirley M. Jorges, Ft. Oglethorpe, Ga. ; a part interest

[21] Appl. No.: 237,665

[22] Filed: Feb. 24, 1981

[51] Int. Cl.[3] ..... D05C 15/00

[52] U.S. Cl. ..... 112/79 R; 112/266.2

[58] Field of Search ..... 112/79 R, 79 A, 79 FR, 112/266.2

[56] References Cited

U.S. PATENT DOCUMENTS 4,303,025 12/1981 Bardsley ..... 112/79 R

*Primary Examiner*—Ronald Feldbaum

*Attorney, Agent, or Firm*—Alan Ruderman

[57] ABSTRACT

A tufting machine and method for producing chain tuft fabric having adjacent rows of chains offset and a loop pile tuft between each chain includes two staggered rows of needles with each needle cooperating with a respective looper, and a loop deflector. The loopers point in the direction of fabric feed to seize and then shed successive loops presented by a respective needle. Each shed loop is deflected by a surface of the deflector facing oppositely to the direction of fabric feed toward the base fabric for entry of the loop by the needle as it descends to form the subsequent loop so that the first loop is concatenated about the succeeding loop. Another set of needles and loop pile loopers downstream from the first set produce the loop pile in the chain loops.

12 Claims, 8 Drawing Figures

APPARATUS AND METHOD FOR FORMING TUFTED PILE FABRIC

BACKGROUND OF THE INVENTION

This invention relates to tufting machines and more particularly to a method and apparatus for forming a fabric having tufted loops in the form of chain links disposed longitudinally in rows on the base fabric. The method and apparatus comprise an alternative to that disclosed in my copending U.S. Pat. application Ser. No. 123,913 filed Feb. 22, 1980, now U.S. Pat. No. 4,285,286, for producing fabric as therein disclosed.

In my aforesaid patent application a fabric having concatenated tufted chain loops which lie substantially flat against the base fabric with the appearance of a berber or crewel look is disclosed as manufactured by a tufting machine having a primary looper and a transfer looper oscillating out of phase with one another, the transfer looper having a bill facing oppositely to the direction of fabric feed and oscillating oppositely relatively to the primary looper to receive and hold loops shed from the primary looper for penetration therethrough by the needle as it descends to form a subsequent loop. A secondary looper operating as aforesaid in conjunction with the primary looper is necessary for the method and apparatus there disclosed.

SUMMARY OF THE INVENTION

The present invention provides a method and apparatus for producing a tufted pile fabric having the pile tufts disposed on the base fabric in the form of chains extending longitudinally substantially parallel to the base fabric between stitching holes. The apparatus includes a loop deflector disposed on the looper side of the base fabric spaced a small amount in the direction of fabric feed from the location of needle penetration, that distance being less than a stitch length, so that a loop shed by the loop pile looper is wiped over the surface of the deflector and laid back under the needle which thereafter enters the loop as the needle descends to form the subsequent loop. Thus, each loop is formed within a prior loop, the first loop being concatenated about the subsequent loop.

Consequently, the present invention provides a simplification of the mechanism disclosed in my aforesaid co-pending patent application by eliminating the necessity of the transfer looper, only conventional loop pile loopers being required to be oscillated in timed relationship with the needles. The loop deflector being a fixed member does not increase the power requirements of the machine vis a vis conventional loop pile tufting machine.

Additionally, another feature of the invention contemplates the insertion of a loop pile tuft into each chain using another yarn system in a manner similar to that disclosed in my prior patent application. To provide the additional loop pile tuft additional needles may be munted for reciprocating into cooperation with loop pile loopers, the needles preferably being mounted in the needle bar with the chain producing needles and the loopers being mounted in the same looper bar with the other loopers, these needles penetrating the fabric at the same points as the other needles.

Consequently, it is a primary object of the present invention to provide in a tufting machine a method and apparatus for producing a pile fabric in the form of a chain against the base fabric and wherein the apparatus includes a loop deflector disposed so that a loop of yarn seized and shed by an oscillating looper cooperating with a reciprocating needle is drawn over the deflector and disposed for entry by the needle during its subsequent loop forming stroke.

It is another object of the present invention to provide in a tufting machine a loop deflecting bar for deflecting a loop shed by a loop pile looper toward the base fabric for entry into the loop of the needle as it descends toward the loop seizing position of the looper.

A further object of the present invention is to provide in a tufting machine an oscillating looper having a bill pointing in the direction in which the base fabric is fed and cooperating with a reciprocating needle to seize a loop of yarn and thereafter shed the loop, and a loop positioning bar having a deflective surface disposed between the base fabric and the looper and spaced from the line of needle reciprocation in the direction in which the fabric is being fed, by an amount less than a stitch length, said surface acting to deflect a shed loop lengthwise toward the surface of the base fabric for entry into the loop by the needle as it descends toward the loop seizing position of the looper.

It is a still further object of the present invention to provide in adjacent lateral rows in a tufting machine needles offset from each other in the direction of fabric feed, each needle cooperating with a respective looper for seizing a loop of yarn presented by the respective needle and thereafter shedding the loop, and a loop deflecting member disposed between the base fabric and the loopers and spaced from the lines of reciprocation of the needles in the direction of fabric feed, by an amount less than a stitch length, said member acting to deflect said loops toward the surface of the base fabric for entry into the loops by the respective needles as they descend toward the loop seizing position of the loopers.

It is yet a further object of the present invention to provide a method for forming a tufted pile fabric having concatenated loops, said method including the deflecting loops shed by the looper toward the line of needle reciprocation for entry of the loop by the needle as it descends to form the subsequent loop.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
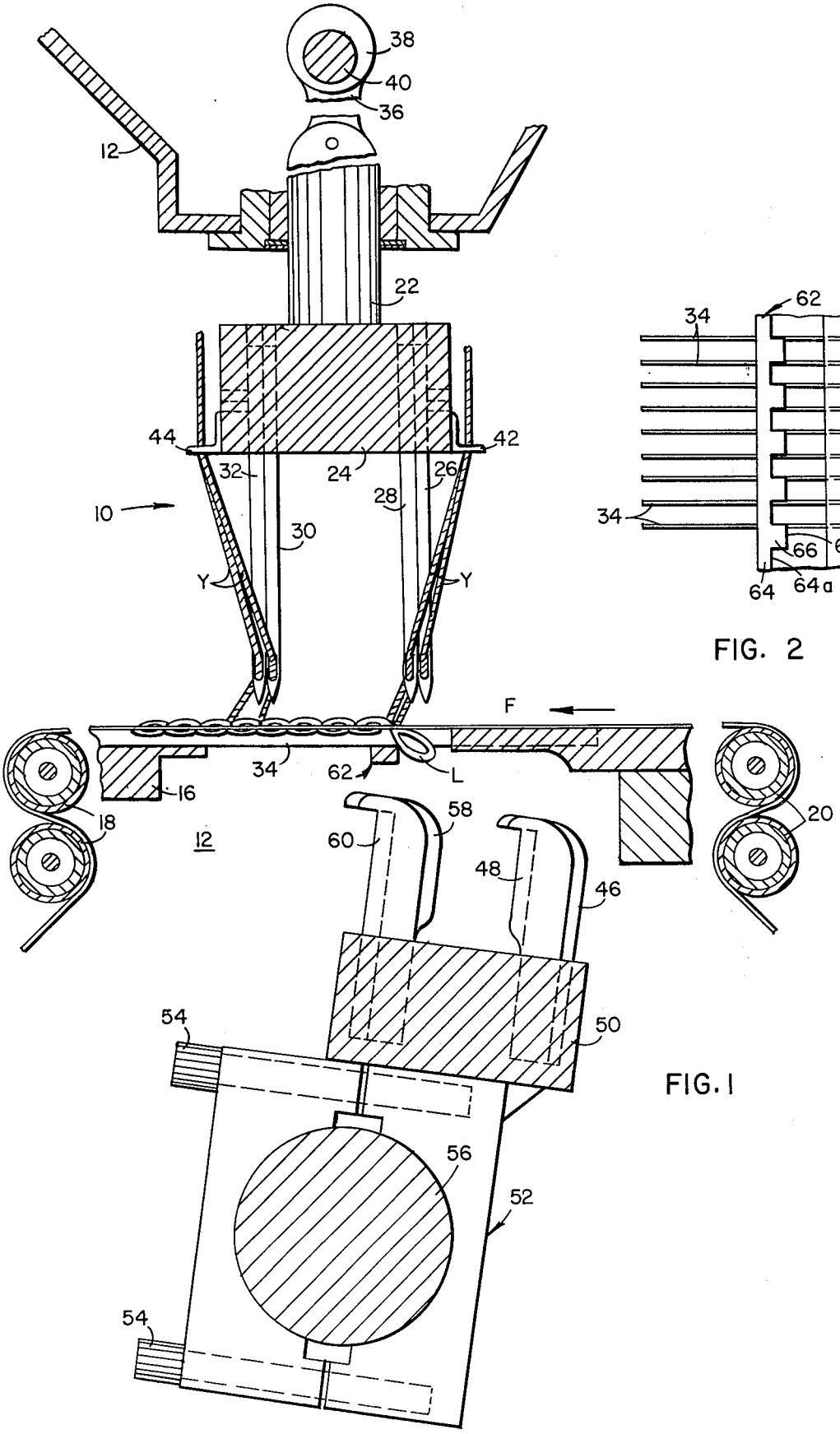
FIG. 1 is a vertical fragmentary sectional view taken transversely through a portion of a multiple needle tufting machine embodying apparatus constructed in accordance with the principles of the present invention and illustrating portions of the machine in diagrammatic form.

Referring now to the drawings, there is illustrated in FIG. 1 a portion of a tufting machine 10 having a frame comprising a bed 12 and a head 14 disposed above the bed. The bed 12 includes a bed plate 16 across which a fabric F is adapted to be fed in the direction illustrated by the arrow by a pair of take-off rolls 18 and feed-rolls 20.

Mounted in the head 14 for vertical reciprocation is one of a plurality of push rods 22 to the lower end of which a needle bar 24 is carried and which in turn carries a first set of a plurality of needles 26 and 28 in a first pair of transverse rows and a second set of a plurality of needles 30 and 32 in a second pair of transverse rows spaced downstream of the needles 26 and 28 in the direction of fabric feed. The needles are adapted to penetrate the fabric through wire support fingers 34 secured to and positioned across an opening in the bed plate 16 upon reciprocation of the needle bar to carry yarn Y therethrough and project loops of yarn from the fabric. Endwise reciprocation may be conventionally imparted to the push rod 22 and thus the needle bar by a linkl 36 pivotably connected at its lower end to the push rod and at its upper end to an eccentric 38 on a driven rotary main shaft 40 that is journalled transversely through the head 14. Yarn jerkers 42 and 44 are carried by the needle bar 24 and operate to engage yarn between the respective rows of needles 26, 28 and 30, 32 and respective conventional yarn feed mechanism (not illustrated) for each transverse pair of needle rows.

Mounted within the bed for cooperation with the needles 26, 28 are a plurality of conventional loop pile loopers 46, 48 which have bills that point in the direction of the fabric feed, the loopers 46 cooperating with the needles 26 and the loopers 48 cooperating with the needles 28 to seize loops of yarn presented by the needles. The loopers 46, 48 have mounting portions receivable within respective slots in a looper bar 50. Secured to the looper bar 50 is one-half of a plurality of two piece clamps 52 which are secured by screws 54 about a looper shaft 56 journalled in the bed substantially parallel to the main shaft 40. The looper shaft 56 is conventionally oscillated or rocked in a back and forth manner in timed relationship with the reciprocation of the needles so that the hooks of the loopers 46, 48 enter the respective loops presented by the needles 26, 28 to seize the loops, and as the loopers rock away from the needle path as the needles ascend, shed the loops which are moved downstream along with the fabric F. Similarly a plurality of second conventional loop pile loopers 58, 60 similar to the loopers 46, 48 are mounted in the looper bar 50 downstream of the loopers 46, 48 to cooperate with the needles 30, 32. To simplify the disclosure, the means for oscillating the looper shaft is not illustrated since this is notoriously well known in the tufting art and any conventional means can be utilized with the present invention. One means for accomplishing this result may be a cam and lever means driven off the main shaft 40.

Figure 2:
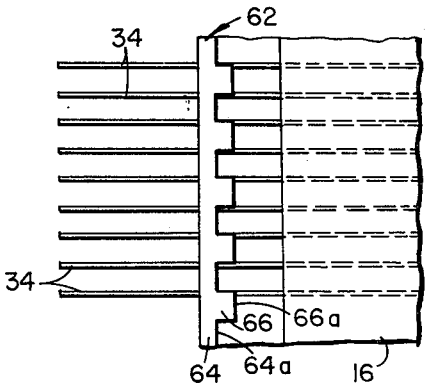
FIG. 2 is a fragmentary bottom plan view of the needle plate of the tufting machine illustrated in FIG. 1 showing the construction of the loop deflecting bar.

In accordance with the present invention a loop positioning or deflecting bar 62 is disposed beneath the bed plate 16 and preferably fastened to the support fingers 34 downstream of the axes of the needles 26, 28 relative to the direction of movement of the fabric F as it is being fed. The bar may have finger receiving slots in the upper surface and the fingers 34 may be positioned within the slots with the bar fastened thereto, or the bar merely may be fastened to the bottom surface of the fingers 34, as by welding or the like. The bar may be an elongated substantially rectangular member as illustrated, but as long as there is a properly disposed loop deflecting surface the specific configuration does not appear critical. Functionally, the bar deflects a loop L shed from the looper and that has been jerked back toward the fabric by the yarn jerker 42 as the loop travels downstream with the fabric. The loops are so deflected by engaging the upstream facing surface of the bar and as they do so each loop is laid back toward the base fabric under the path of needle reciprocation of the respective needle so that the needle may enter the loop as the needle descends through the fabric to project another loop therein as it moves toward loop seizing relationship with the respective looper. Thus, to properly deflect the loops, the deflecting surface should be spaced downstream form the point of needle penetration by an amount less than the stitch length produced so the loop is deflected back under the path of the needle. Because there are two sets of needles 26, 28 disposed in spaced staggered rows in the preferred embodiment of the machine, and it is preferred that both sets of needles produce concatenated chains, both sets of loops must be deflected. It is preferred that rather than having two separate loop positioning bars, one acting to deflect loops produced by needles 26, and one to deflect loops produced by needles 28, a single bar 62 be utilized. To this end the bar 62 is formed in stepped fashion as best illustrated in FIG. 2. Thus, the bar has a main transversely elongated portion 64 having surfaces **64*a* to deflect the loops deposited by the needles 28, and upstream extended portions 66 having surfaces 66*a* alternating with and staggered relatively to the main portion surfaces 64*a* to deflect the loops created by the needles 26**.

Figure 3:
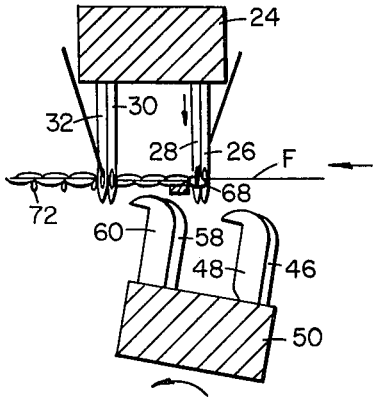
FIGS. 3 through 8 illustrate schematically a number of operative steps in the cycle for forming concatenated loops with the apparatus illustrated in FIG. 1.
Figure 4:
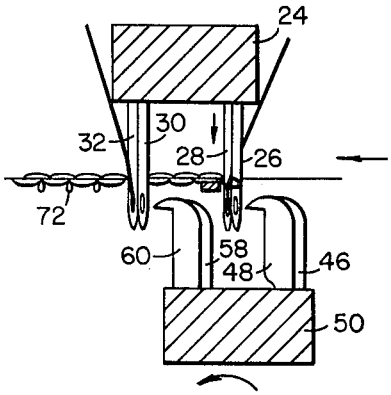

The operation of the machine may be understood readily with reference to FIGS. 3 through 8 which depict schematically the tufting cycle, the movement of travel of the stitch forming instrumentalities being slightly exaggerated for purposes of presentation. In FIG. 3 the looper bar 50 and the loopers have begun to move from the extreme position away from the needle paths subsequent to loop shedding and are rocking counter-clockwise. The needles at this instant are descending and have already penetrated the fabric F. The needles 26, 28 have entered the previously formed loops 68. The needles continue to descend through the loops 68 as the loopers continue to rock counter-clockwise toward the needle paths as illustrated in FIG. 4.

Figure 5:
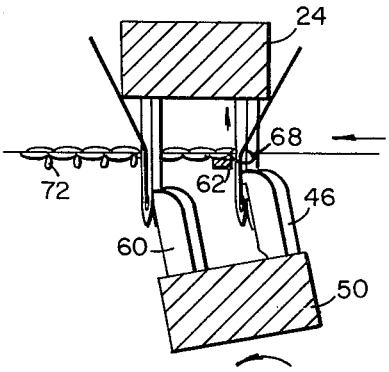
Figure 6:
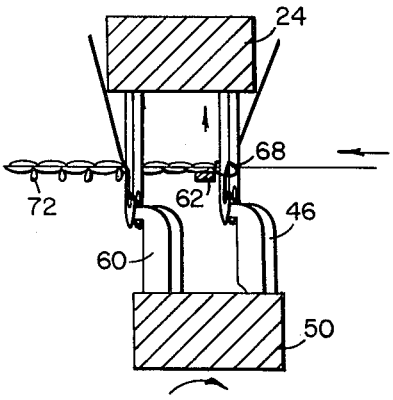
Figure 7:
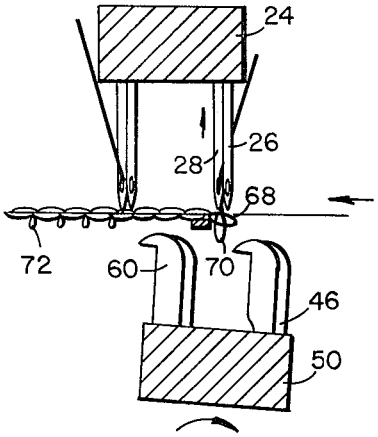
Figure 8:
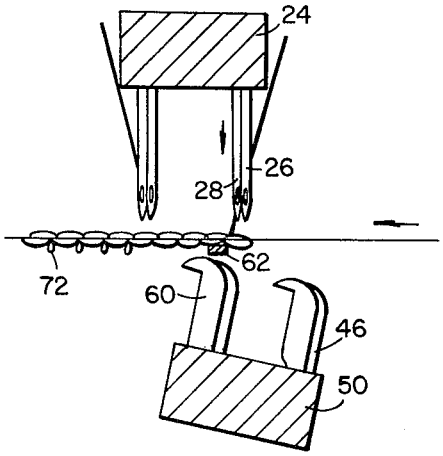

As the loopers and the needles continue moving in the above stated directions to the position illustrated in FIG. 5, the loopers 46, 48 enter the subsequent loops presented by the needle as the needles have begun to ascend. As the needles continue to ascend the loopers seize the loops and rock clockwise with a seized loop as depicted in FIG. 6, the loop 68 still being encircled about the respective needle. In FIG. 7 the loopers continue their clockwise rocking movement and shed the loop 70 while the needle, as it continues to ascend, exits from the loop 68 which remains looped or concatenated about the newly formed loop 70. As the needle further continues upwardly the loop 70 is being jerked therewith by the yarn jerker 42, so that the loop 70 engages and is laid back against the loop deflecting surface of the bar 62, as depicted In FIG. 8. The loop 70 is thus deflected upwardly toward the fabric F, it being understood that the loops are moving downstream to the left with the fabric. Consequently, since the loop 70 is extended outwardly toward the needle path as it is deflected, rather than merely hanging downwardly as a conventional uncut loop such as loop 72 formed by needles 30, 32 and loopers 58, 60, the neeles 26, 28 may enter the so presented loops 70 as they had entered the previously formed loop 68 depicted in FIG. 3.

A second pair of needles 30, 32 are spaced from the first pair of needles 26, 28 so that a conventional uncut loop tuft 72 is inserted and placed intermediate each pair of chain tufts formed by the needles 26, 28. Thus, the unique fabric as illustrated in my aforesaid co-pending patent application may be produced.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus described the nature of the invention, what is claimed herein is:

1. A method of tufting pile fabric comprising supporting and feeding a base fabric in one direction, reciprocating a yarn carrying needle to stitch the yarn continuously through said base fabric to form a row of successive yarn loops on one side of said fabric, supporting on said one side of said fabric a first looper having a free end pointing in said one direction, oscillating said looper so the free end enters and seizes and thereafter sheds the loops in succession, and deflecting each loop in succession toward said base fabric into the path of said needle so said needle enters the preceeding loop as it forms each loop.

2. A method of tufting pile fabric comprising, supporting and feeding a base fabric in one direction, penetrating a yarn through the base fabric at a point to form a first loop on one side of said fabric, supporting on said one side a first looper having a free end pointing in said one direction, moving said looper so its free end enters and seizes said loop and thereafter sheds said loop, supporting upon said one side a loop deflector intermediate said fabric and said looper and spaced less than a stitch length from the point of penetration of said yarn in said one direction, moving said first loop over said loop deflector to deflect said loop toward said base fabric, penetrating the yarn through said fabric and said loop at a location displaced by a stitch length along the line of feed from the point of penetration of the first loop to form a second loop on said one side, and drawing said first loop over said bar by the feeding of said fabric.

3. A Method of tufting pile fabric as recited in claim 1, including subsequently penetrating another yarn through said base fabric substantially at the penetration of said second loop to form a third loop, supporting on said one side a second looper having a free end pointing in said one direction, relatively moving said second looper so its free end enters and seizes said third loop, and shedding said third loop to form a loop tuft intermediate said first and second loops.

4. In a tufting machine having means for feeding a base fabric in one direction, a yarn carrying needle disposed on one side of the base fabric, means for reciprocating the needle for penetrating the base fabric at a point and forming loops therein, means for supporting on the opposite side of the base fabric a looper having a free end pointing in said one direction, and means for oscillating said looper toward and away from the path of said needle so that the free end enters, seizes and then sheds successive loops, the combination of a loop positioning member, said member having a loop deflecting surface facing in the direction opposite to said one direction, means for supporting said member with said surface at a disposition intermediate said looper and said base fabric and spaced in the direction of fabric feed from the point of penetration of said needle by an amount less than a stitch length, whereby each loop shed from looper is successively deflected by said surface as the loop is fed over said member and spread for entry by said needle in forming the subsequent loop.

5. In a tufting machine as recited in claim 4, wherein said looper is disposed below said base fabric a distance that is greater than said stitch length.

6. In a tufting machine as recited in claim 4, including a second yarn carrying needle disposed in the line of feed and spaced in the direction of feed relatively to said first needle, means for reciprocating said second needle for penetrating said base fabric for forming loops therein, means for supporting on the opposite side of the base fabric a second looper having a free end pointing in said one direction, and means for oscillating said second looper toward and away from the path of said second needle so the free end enters, seizes and then sheds successive loops, said second needle being disposed for penetrating said base fabric at substantially the penetration of said first needle.

7. In a tufting machine having means for feeding a base fabric in one direction, means for supporting said fabric as it is being fed, a plurality of yarn carrying needles spaced transversely to said one direction disposed on one side of said base fabric, means for reciprocating said needle for penetrating said fabric at spaced points and forming loops therein, means for supporting on the opposite side of the base fabric a plurality of loopers corresponding in number to the number of needles, each looper having a free end pointing in said one direction, and means for oscillating each looper toward and away from the path of a respective needle so that the free end of each looper enters, seizes and then sheds successive loops presented by the respective needle, the combination of a loop positioning member, said member having a loop deflecting surface for each looper facing in the direction opposite to said one direction, means for supporting said member such that each of said surfaces is at a disposition intermediate the respective looper and said base fabric and spaced in the direction of fabric feed from the point of penetration of the respective needle by an amount less than a stitch length, whereby each loop shed from a looper is successively deflected by the respective surface as the loop is fed over said member and spread for entry by the respective needle in forming the subsequent loop.

8. In a tufting machine as recited in claim 7, wherein each looper is disposed below said base fabric a distance that is greater than the length of the stitch produced by the respective needle.

9. In a tufting machine as recited in claim 7, wherein said means for supporting said fabric comprises a plurality of fingers spaced transversely to said one direction across the machine intermedite points of needle penetration, and means for fastening said loop positioning member to said fingers.

10. In a tufting machine as recited in claim 7, wherein said needles are disposed in two transverse rows, the needles in one row being staggered relatively to the needles in the second row, said loopers having free ends similarly staggered so that each looper cooperates with one needle, said loop positioning member having two rows of staggered loop deflecting surfaces, the surfaces of one row acting to deflect loops shed by loopers cooperating with the needles in said one row, and the surfaces of the other row acting to deflect the other loops.

11. In a tufting machine as recited in claim 10, wherein said means for supporting said fabric comprises a plurality of fingers spaced transversely to said one direction across the machine intermediate points of needle penetration, and means for fastening said loop positioning member to said fingers.

12. In a tufting machine as recited in claim 10, including a plurality of second yarn carrying needles each disposed in the line of feed of a first needle and spaced therefrom by the same distance in the direction of feed, means for reciprocating said second needles for penetrating the base fabric for forming loops therein, means for supporting on the opposite side of the base fabric second loopers corresponding to each second needle, each second looper having a free end pointing in said one direction, and means for oscillating said second loopers toward and away from the path of a corresponding second needle so the free end of each second looper enters, seizes and then sheds successive loops presented by the respective second needles, said second needles being disposed for penetrating said base fabric at substantially the penetration of the respective first needles.

* * * * *